United States Patent [19]

Beckerer

[11] 4,301,826

[45] Nov. 24, 1981

[54] COMBINATION SIPHON AND POSITIVE ACTION PUMP

[76] Inventor: Frank S. Beckerer, 134 Far Horizon Dr., Easton, Conn. 06612

[21] Appl. No.: 110,142

[22] Filed: Jan. 7, 1980

[51] Int. Cl.[3] ..... F04F 10/00

[52] U.S. Cl. ..... 137/149; 137/151; 137/854; 447/555 R

[58] Field of Search ..... 137/148, 149, 151, 854, 137/533.27; 417/555 R

[56] References Cited

U.S. PATENT DOCUMENTS

| | | | |
|---|---|---|---|
| 104,641 | 6/1870 | Pitman | 137/148 |
| 755,941 | 3/1904 | Roberts | 137/149 |
| 1,804,270 | 5/1931 | Palich | 137/149 |
| 2,576,637 | 11/1951 | Patriquin | 137/854 X |
| 2,854,017 | 9/1958 | Jordan et al. | 137/149 |
| 3,006,282 | 10/1961 | Sisson | 417/555 |
| 3,124,080 | 3/1964 | Sisson | 417/555 X |
| 3,669,575 | 6/1972 | Beckerer | 417/555 |
| 4,257,445 | 3/1981 | Cook et al. | 137/533.27 X |

FOREIGN PATENT DOCUMENTS

| | | | |
|---|---|---|---|
| 11047 | of 1892 | United Kingdom | 137/149 |

*Primary Examiner*—Gerald A. Michalsky

*Attorney, Agent, or Firm*—H. Gibner Lehmann; K. Gibner Lehmann

[57] ABSTRACT

A combination vacuum lift pump and siphon for handling liquids, comprising a pump cylinder having an inlet disposed near one end and an outlet adjacent to but spaced from the other end, a piston reciprocatable in the cylinder, and a plunger and handle connected therewith, and a pair of check valves, one of which is associated with the piston and is operable to be closed when the plunger is lifted in the cylinder, and the other of which is disposed at the cylinder inlet and is operable to be closed when the plunger is lowered in the cylinder. The outlet of the cylinder is spaced a short distance from the upper end thereof, such that for siphon operation the piston and its check valve can be moved to a position in the cylinder which is beyond the location of the outlet. Accordingly, the flow of liquid by-passes the piston check valve completely, and the latter thus does not act in such a manner as to restrict the siphon flow, as was the case in many other constructions. In addition, the present device can operate, without modification, as either a siphon, or a complete positive-action hand pump in the event that gravity-type siphoning is not possible.

4 Claims, 8 Drawing Figures

COMBINATION SIPHON AND POSITIVE ACTION PUMP

BACKGROUND

This invention relates generally to hand-operated siphons of the type adapted to enable transfer of liquids from one vessel to another.

In the past, a number of different siphon constructions have been proposed and produced, and have met with varying degrees of success. Prior siphons have incorporated cylinders carrying reciprocatable pistons which were operated by handles that were disposed outside the cylinder body. In most cases, the plunger functioned merely to permit initial evacuation of a portion of the cylinder so as to cause the fluid that was being siphoned to be drawn into the cylinder, for starting up the siphoning action. Several prior siphons incorporated sufficient room at the top of the cylinder such that the piston could be driven past the outlet line to a storage position which was out of the path of flow of the liquid being siphoned.

While the above constructions were satisfactory in some respects, a number of distinct disadvantages became apparent to the user when he attempted to put these devices into operation. In cases where the inlet hose was connected to the bottom of the cylinder, and in instances where the length of the inlet hose was appreciable, very often it was not possible to initiate the necessary siphoning action. This occurred mainly in siphon constructions employing a relatively small diameter cylinder, and resulted from the fact that the displacement of the piston in the cylinder was less than the volume of air occupying the inlet hose. Under such cirmumstances, even with a complete withdrawal of the plunger and piston, the resulting evacuation of the cylinder was insufficient to cause an adequate quantity of liquid to reach the outlet line such that siphoning action could begin. With such devices, the only solution was to either shorten the inlet hose considerably, so as to minimize the trapped air in the system, or to manually prime the siphon by filling the inlet hose with liquid, thus getting rid of the trapped air and permitting the start of the siphon action after the plunger was initially withdrawn.

Other disadvantages became apparent with most of the prior art devices, where the difference in level between the supply-vessel and the bottom of the outlet hose was small. In such cases, the resulting pressure was often insufficient to support a reasonably good flow rate. The only solution to this problem was to increase the height of the supply-vessel, or alternately to employ a siphon arrangement incorporating larger diameter cylinders and corresponding hosing of increased size. However, frequently there were restrictions as to the maximum size siphon that could be used, due to space limitations such as commonly encountered in the marine facilities, or transportation vehicles, etc., with which these devices were typically employed. In addition, physically large components were considered too cumbersome to store because of their bulkiness, and in many cases not appealing to the consumer, whether he be an individual or an industrial concern.

Of course, in cases where there existed no difference in levels between the supply tank and the receiving tank, siphoning was not possible at all. A separate, manual pump was then required.

SUMMARY

The above disadvantages and drawbacks of many prior siphon constructions are obviated by the present invention which has for an object the provision of a novel and improved combination vacuum-lift pump and siphon which is simple in construction, reliable in operation, and which can be used as either a pure siphon, or alternately as a positive-action vacuum-lift pump, all without modification of the physical structure thereof.

A related object of the invention is to provide a combination siphon-pump having excellent free-flow characteristics when used as a siphon, and not involving any complex valving arrangements which would interfere with the low-pressure, low velocity flow rates which characterize simple gravity-type siphons.

Stil another object is to provide a combination siphon-pump as above, incorporating simple parts which can be readily molded in plastic, and which can be assembled to one another with a minimum of time and effort.

Yet another object of the invention is the provision of a siphon-pump which is physically small and light weight and which is completely self-contained, thus constituting a device which is especially compact and non-bulky, this feature facilitating both storage and use of the device.

A still further object is to provide a siphon-pump having an inlet arrangement wherein the direction from which liquids can be drawn is variable, merely by substitution of an end cap of modified construction, in the lower end of the pump cylinder.

The above objects are accomplished by a combination positive-action vacuum-lift pump and siphon comprising a pump cylinder having an inlet adjacent its bottom, and an outlet spaced downward from its top, a piston having a check-valve operable to be closed when the piston is raised, and an additional check-valve disposed inside the cylinder and connected with the inlet thereof, to restrict movement of liquid downward in the cylinder and back through the inlet. The arrangement is such that liquids which are drawn into the cylinder can flow outward through the outlet line, either under pumping action of the piston where it is being reciprocated, or alternately by means of a siphoning action when the piston is moved to a storage position in the cylinder past the location of the outlet line. Accordingly, the device can operate either as a positive-action pump, or alternately as a pure siphon, all without any modification of the physical structure of the device. Moreover, the structure that is necessary to accomplish either type of action is completely self-contained in the pump housing, thus providing an especially compact and light weight assembly which is easy to use, convenient to store, and reliable in operation.

In the accompanying drawings illustrating several embodiments of the invention:

Referring to FIGS. 1-4 and in accordance with the present invention there is provided a novel and improved combination vacuum-lift pump and siphon adapted to transfer liquid from one vessel to another, the device permitting operation as either a pure siphon, or a positive-action pump in the event that siphon action is not possible, or where an increased transfer rate is desired over that which would be possible with a pure siphon.

Figure 1:
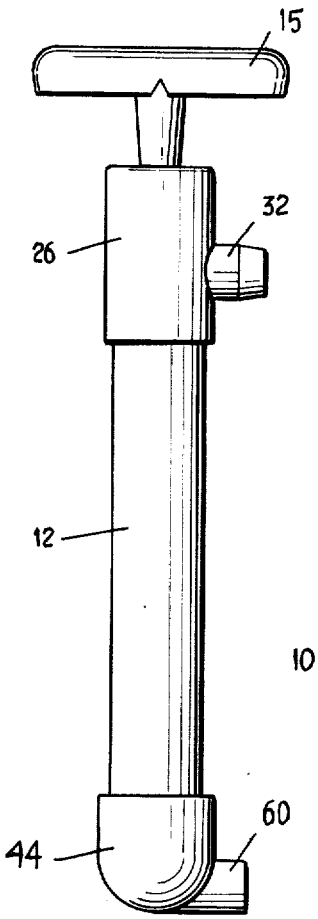
FIG. 1 is a front elevational view of the improved combination siphon-positive action pump of the present invention.
Figure 2:
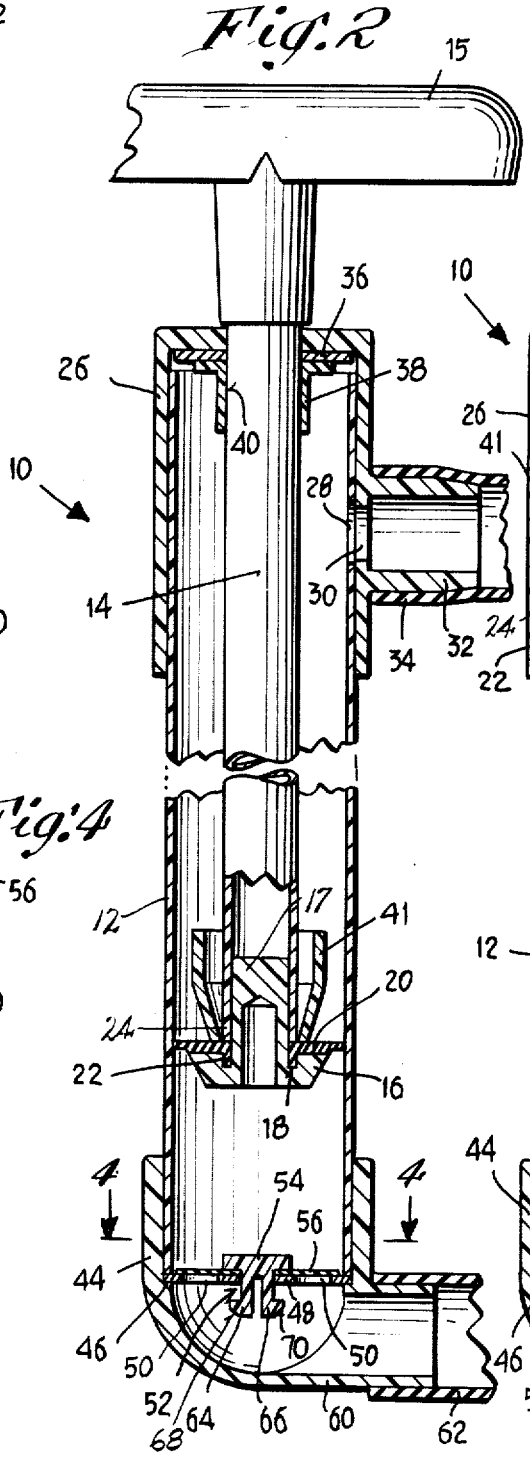
FIG. 2 is a vertical section of the siphon-positive action pump of FIG. 1, particularly illustrating the pump cylinder, piston, and check valves associated therewith, the piston occupying a low position in the cylinder.
Figure 3:
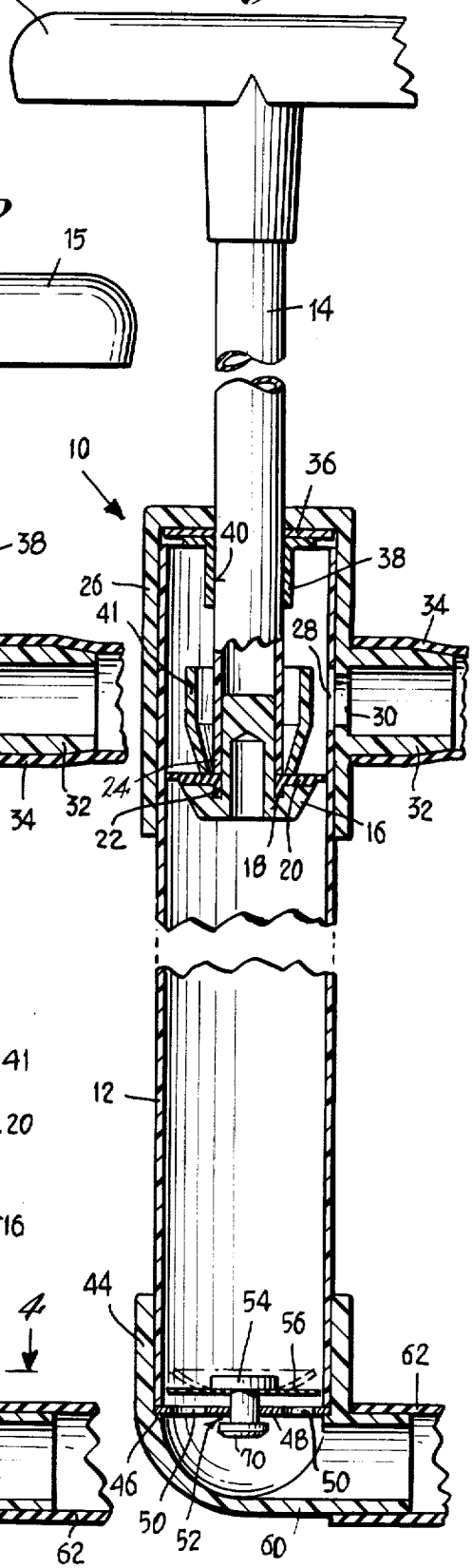
FIG. 3 is a view like FIG. 2, except showing the piston occupying a higher position in the pump cylinder.
Figure 4:
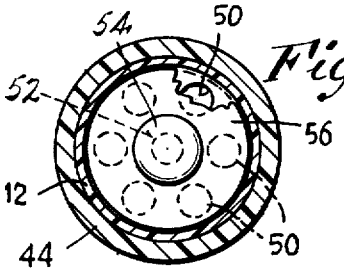
FIG. 4 is a section taken on the line 4—4 of FIG. 2.

The device is shown in section in FIGS. 2 and 3, and is generally designated by the numeral 10. It includes a tubular pump cylinder 12 in which there reciprocates a plunger 14 carrying a handle 15. Fitted in the end of the plunger 14 is a piston plug 16 comprising a tubular boss 17 pressed into the end of the plunger, and having an annular groove 18 which receives a resilient flap 20 having peripheral portions engaging the inner wall surface of the pump cylinder 12 and constituting a piston valve. The flap 20 has a skirt portion 22 which is received in the groove 18, and held in place by suitable means. In addition, further retention is realized as a result of the end 24 of the plunger 14 engaging the inner peripheral area of the flap 20 so as to hold the latter in position as in FIG. 2.

The upper end of the cylinder 12 is fitted with an end cap 26. The cylinder has an aperture 28, and a similar aperture 30 in the end cap 26 is provided, the latter also including a tubular boss 32 enabling an outlet hose 34 to be retained on the cap 26 as shown.

Fitted into the end cap 26 is a force-distribution washer 36, and a sealing sleeve 38, having an expansive inner cylindrical surface or seal 40 which engages the cylindrical surface of plunger 14 so as to minimize the possibility of leakage of fluid past the plunger 14 and toward the handle. An abutment ring 41 is carried on the plunger 14, and is adapted to engage the sealing sleeve 38 when the plunger is withdrawn, the ring serving as a stop to limit the displacement of the plunger in one direction, and thereby prevent the plunger from being withdrawn too far.

Disposed at the lower end of the pump cylinder 12 in FiG. 2 is an end fitting 44 which is secured to the cylinder 12. Carried in the fitting 44 against a shoulder 46 thereof is an apertured valve plate 48 having multiple openings 50 particularly illustrated in FIG. 4, and having a central opening 52 which receives a floating mounting button or thimble 54. The mounting button, which could be in the nature of a rivet, secures in place a membrane or flap 56 as shown, the flap normally closing off the apertures 50 and preventing liquid from flowing therethrough. The membrane 56 could be either flexible, or rigid. The fitting 44 has an inlet port 60 to which there is secured an inlet hose 62.

As shown, button 54 is bifurcated, comprising fingers 64, 66 having cam surfaces 68, 70 by which the fingers 64, 66 can be sprung toward one another, as occurs during the installation of the button 54 into the central aperture of the plate 48. Following such installation, the button 54 will be held captive, but is capable of shifting axially with respect to the plate 48 under the action of liquid flowing through the apertures 50 in an upward direction in FIG. 3. The upward movement of the button 54 is limited by the engagement of the shoulders of the fingers 64, 66 and the wall surrounding the central aperture 52.

Figure 6:
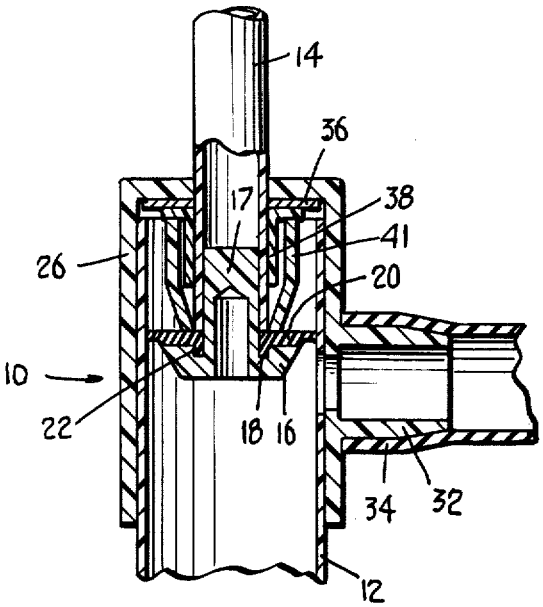
FIG. 6 is a view like FIG. 3, except showing the piston occupying a still higher position in the pump cylinder.

In operation, liquid flows into the combined siphon-pump through the inlet hose 62, and out through the hose 34. With the free end of the inlet hose 62 submerged in the vessel to be evacuated, the plunger 14 is drawn upwardly as in FIG. 3, creating a vacuum in the cylinder 12 below the location of the plug 16. This has the effect of drawing liquid through the apertures 50 and into the lower portion of the cylinder 12. It will be understood that if the length of the hose 62 is appreciable, liquid may not be drawn past the flap 56 on the first upward stroke. Nevertheless, the evacuation of air from the lower portion of the cylinder 12 results in some initial draw of liquid into the hose 62. With plunger 14 approaching the position shown in FIG. 3, the direction of travel can now be reversed. Under such circumstances the flap 56 will close off the apertures 50, with the button 54 occupying the position of FIG. 2. Since the flap 56 operates in the manner of a check valve, the air (or liquid) occupying the area below the plug 16 will be forced past the valve flap 20 as the plunger 14 is depressed, since there is nowhere else for the fluid to go. Upon reaching the bottom part of the stroke, FIG. 2, the plunger 14 is then raised, thus drawing more liquid into the cylinder 12 (or alternately drawing any liquid which occupies the hose 62 closer to the fitting 44). Eventually a point will be reached wherein the cylinder is completely filled with liquid. At this point, the piston 14 is then withdrawn as in FIG. 6, such that the tubular boss 32 and outlet hose 34 communicate with the interior of the cylinder. Liquid will then begin to flow out through the hose 34 by gravity, assuming that the lower end of the hose 34 is below the level of fluid in the vessel from which the liquid is being drawn. Accordingly, a pure siphon action will take place as long as the relative levels remain adequate.

In the event that it is desired to stop the siphon action, it is only necessary to position the plunger 14 at a point in the cylinder 12 below the location of the aperture 28. Due to the resilience of the valve 20, the gravity force generating the siphon action will be insufficient to bypass the valve.

While the above construction can operate as a pure siphon, as noted above, it is also capable of pumping in a positive manner, even in cases where the level of the outlet line 34 is above that of the fluid in the reservoir from which the liquid is being drawn. The pumping action occurs as described above in connection with the start (or priming) of the siphon, but instead, the piston is reciprocated in an upward direction only to a point just below the location of the aperture 28. The present device thus has great utility, since in most all of the prior pump-siphon arrangements heretofore known and constructed, it was not possible to operate and use a single structure for either pure siphoning or positive-action pumping operation with absolutely no modification of the structure. There is thus realized great flexibility in the present device, merely by altering the nature of the stroke of the piston 14, in order to achieve either type of fluid-transfer action. Since both valves 20 and 56 are disposed completely within the pump cylinder 12, an extremely compact structure is realized. The chances of malfunction are minimized, since these valves are not accessible to the user, and are thus not subject to damage from mechanical shock, jarring, tearing, etc.

The present construction is also seen to have the advantage of great simplicity, since the various parts making up the structure can be readily molded in simple cavities. The arrangement wherein the apertured plate 48 is sandwiched between the shoulder 46 and the end of cylinder 12 effectively solves the problems associated with proper positioning of the plate and with permanent retention thereof; this thus represents a distinct improvement over many prior devices, from the standpoint of ease of assembly.

The unique construction of the retainer button 54 enables the flap 56 to uncover the apertures 50 with a minimum of resistance to liquid flow when the device is being used as a pure siphon. Depending upon the rate of flow, it is possible that the flap 56 would not shift uniformly as illustrated in FIG. 3, although where flow rates were high, this is probably a good representation of the position that the flap would occupy. Since both flow rates and pressures can be very low where siphoning is being employed, it is especially important that any valving arrangement which is disposed in the path of liquid flow not adversely restrict such flow. This particular arrangement, wherein the flap can readily uncover some or all of the apertures 50, is very effective from the standpoint of permitting good flow rates to be achieved, thus making the device more efficient as a siphon.

Figure 5:
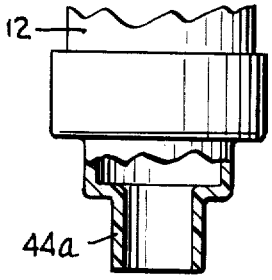
FIG. 5 is a fragmentary view of a pump construction showing a different style of inlet fitting, constituting another embodiment of the invention.

Another embodiment of the invention is shown in FIG. 5, showing a modified end fitting **44*a* having a bore whose axis is substantially parallel to the axis of the cylinder as opposed to the construction of FIGS. 1–4 wherein the bore is perpendicular to the axis of the cylinder. Either fitting can be used with the one cylinder 12, depending on the configuration of the containers with which the siphon-pump is being used, and also on the nature of the space that is available for manually operating the plunger 14 and handle 15**.

Figure 7:
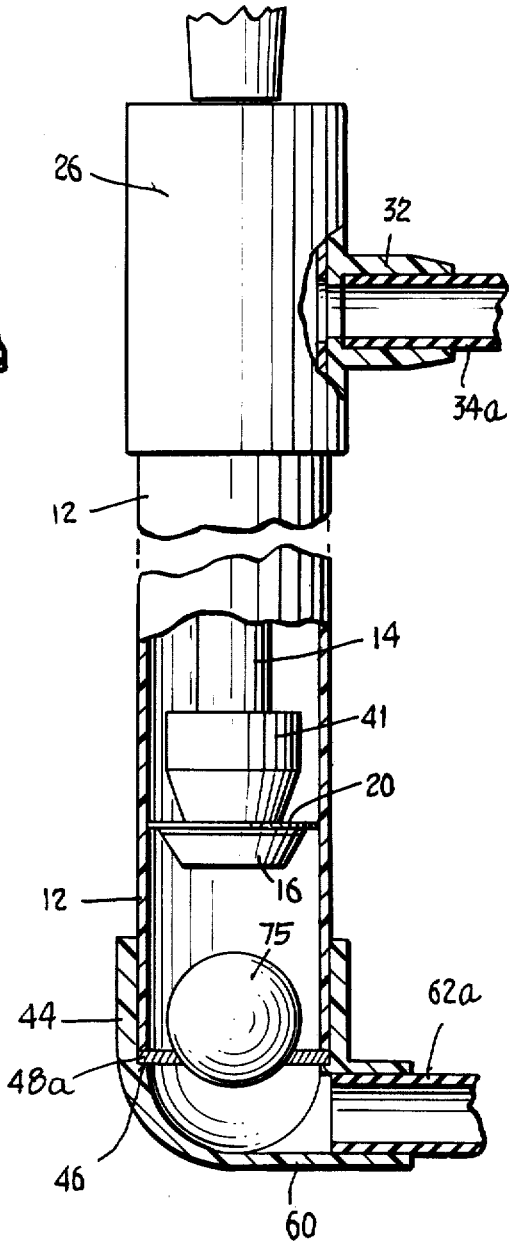
FIG. 7 is a view, partly in vertical section and partly in front elevation, showing a modified siphon-pump incorporating a simple ball-type check valve adjacent the inlet fitting, this construction constituting another embodiment of the invention.

Still another embodiment of the invention is shown in FIG. 7, illustrating a modified siphon-positive action pump incorporating a different type of check-valve adjacent the inlet fitting of the structure.

As in the previous embodiment, the device comprises a cylinder 12, plunger 14, piston plug 16 and yieldable flap 20, the periphery of which engages the inner wall surface of the cylinder 12. An end cap 26 is provided, having a tubular boss 32 into which there is fitted an outlet hose **34*a*. Disposed at the lower end of the cylinder 12 is an end fitting 44, in which there is carried an inlet hose 62*a***.

By the present invention, an especially simple check-valve arrangement is provided, in the form of an apertured valve plate **48*a* and floating ball 75. The latter can be constituted of steel, glass or other suitable materials, and is adapted to seat against the walls of the aperture in the plate 48*a* when the pump cylinder is upright, as in FIG. 7, as well as under conditions where the plunger 14 is being moved downward in the cylinder 12, toward the inlet port 60. This construction has the advantage of extreme simplicity, resulting in a reduced manufacturing cost and somewhat easier assembly. In the event that the device of FIG. 7 is intended to be used as a siphon, the cylinder 12 can be tilted from a vertical position by a slight amount, sufficient to unseat the ball 75, providing a virtually completely unobstructed path for liquid flow through the inlet port to the interior of the cylinder 12**. Accordingly, resistance to such flow is minimized, this being especially important where the device is being used as a siphon and where relatively small pressure differences exist. Tilting of the cylinder to a more or less vertical position will, of course, cause the ball to rest by gravity in the aperture, thereby permitting pump-type operation to be achieved.

Figure 8:
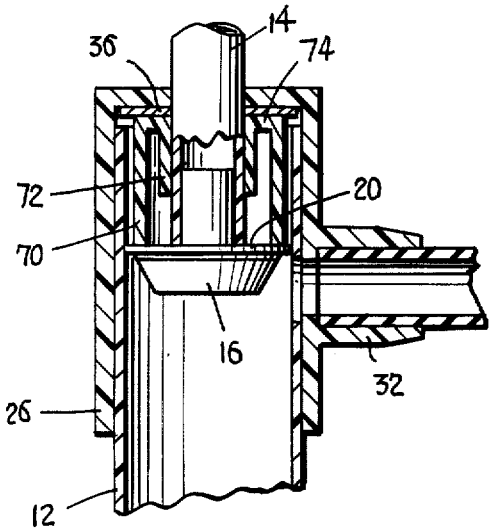
FIG. 8 is a fragmentary section of a further modified construction, incorporating a different type of abutment for the piston.

Yet another embodiment of the invention is shown in FIG. 8, which illustrates a slightly modified pump construction incorporating a different type of abutment for the piston, such abutment being carried by the end cap 26 and being integral with the seal for the plunger 14. The abutment is in the form of a cup, having spaced outer and inner walls 70, 72, the latter constituting the seal. A bottom wall 74 seats against and is joined to the washer 36.

By virtue of the fact that there is involved one less piece, there results simplified assembly, as well as reduced manufacturing cost. The arrangement shown in FIG. 8 can be substituted for the construction of FIGS. 2, 3 and 6, with the outer wall 70 of the modified structure being adapted to engage the flap 20 and constitute a stop for the piston when the plunger 14 is withdrawn fully, as in FIG. 6. In other respects, the operation of this modification is substantially identical to that of the embodiment of FIGS. 1–4 and 6, and accordingly, need not be repeated.

The improved combined positive-action pump and siphon constructions of the present invention are thus seen to constitute distinct advances and improvements in the technology of liquid transfer mechanisms.

Each and every one of the appended claims defines a distinct aspect of the invention separate from the others, and each claim is accordingly to be treated in this manner when the prior art devices are examined in any determination of novelty or validity.

Variations and modifications are possible without departing from the spirit of the invention.

What is claimed is:

1. A combination vacuum lift pump and siphon for handling liquids, comprising in combination:

(a) a pump cylinder having an inlet adjacent its bottom, and an outlet spaced downward from its top, (b) a discharge line connected to said outlet and depending therefrom, (c) a plunger reciprocatable in the cylinder, including a piston movable from a location low in the cylinder to a location above the said outlet, (d) said piston having a check valve operable to be closed when the plunger is lifted to raise the piston, (e) an additional check valve connected with said inlet to restrain movement of liquid out of the cylinder through said inlet, (f) reciprocative movements of said piston in portions of said cylinder below said outlet being operative to vacuum lift liquid into the cylinder through said inlet, and to force said liquid out of said outlet, (g) said piston when raised in the cylinder above said outlet enabling a siphon action to occur whereby gravity flow of liquid through said discharge line will suck liquid into the cylinder through said inlet and past said inlet check valve, (h) said additional check valve comprising an apertured valve plate disposed at the bottom of the cylinder and in the path of liquid flow, (i) a valve membrane adjacent said plate and adapted to close off the apertures therein in response to the tendency for liquid to flow in one direction, (j) said apertured valve plate and said membrane having central openings adapted to be aligned with one another, (k) a securement thimble extending through said aligned openings and retaining the membrane against permanent dislodgement from the apertured valve plate, (l) said thimble having spaced-apart annular shoulder means, one of said shoulder means being engageable with said plate and the other of said shoulder means being engageable with the membrane to enable the latter to occupy a position completely spaced from the plate under the action of liquid flowing into the inlet, (m) the distance between said shoulder means being substantially in excess of the combined thicknesses of the plate and membrane in order to permit the latter to occupy said spaced position with respect to said plate, so as to present minimal impedement to the flow of liquid through said apertures when the membrane is spaced from the plate, (n) said thimble being loosely carried by both the apertured valve plate and the membrane, so as not to interfere with movement of the latter away from the apertures under the action of liquid flowing therethrough.

2. A combination vacuum lift pump and siphon for handling liquids, comprising in combination:

(a) a pump cylinder having an inlet adjacent its bottom, and an outlet spaced downward from its top, (b) a discharge line connected to said outlet and depending therefrom, (c) a plunger reciprocatable in the cylinder, including a piston movable from a location low in the cylinder to a location above the said outlet, (d) said piston having a check valve operable to be closed when the plunger is lifted to raise the piston, (e) an additional check valve connected with said inlet to restrain movement of liquid out of the cylinder through said inlet, (f) reciprocative movements of said piston in portions of said cylinder below said outlet being operative to vacuum lift liquid into the cylinder through said inlet, and to force said liquid out of said outlet, (g) said piston when raised in the cylinder above said outlet enabling a siphon action to occur whereby gravity flow of liquid through said discharge line will suck liquid into the cylinder through said inlet and past said inlet check valve, (h) said additional check valve comprising an apertured valve plate disposed at the bottom of the cylinder and in the path of liquid flow, (i) a valve membrane adjacent said plate and adapted to close off the apertures therein in response to the tendency for liquid to flow in one direction, (j) said apertured valve plate and said membrane having central openings adapted to be aligned with one another, (k) a securement thimble extending through said aligned openings and retaining the membrane against permanent dislodgement from the apertured valve plate, (l) said thimble having spaced-apart annular shoulder means, one of said shoulder means being engageable with said plate and the other of said shoulder means being engageable with the membrane to enable the latter to occupy a position completely spaced from the plate under the action of liquid flowing into the inlet, (m) the distance between said shoulder means being substantially in excess of the combined thicknesses of the plate and membrane in order to permit the latter to occupy said spaced position with respect to said plate, so as to present minimal impedement to the flow of liquid through said apertures when the membrane is spaced from the plate, (n) said thimble being axially split at one end, to facilitate insertion of the one end through the aligned openings in the plate and membrane.

3. A combination vacuum lift pump and siphon for handling liquids, comprising in combination:

(a) a pump cylinder having an inlet adjacent its bottom, and an outlet spaced downward from its top, (b) a discharge line connected to said outlet and depending therefrom, (c) a plunger reciprocatable in the cylinder, including a piston movable from a location low in the cylinder to a location above the said outlet, (d) said piston having a check valve operable to be closed when the plunger is lifted to raise the piston, (e) an additional check valve connected with said inlet to restrain movement of liquid out of the cylinder through said inlet, (f) reciprocative movements of said piston in portions of said cylinder below said outlet being operative to vacuum lift liquid into the cylinder through said inlet, and to force said liquid out of said outlet, (g) said piston when raised in the cylinder above said outlet enabling a siphon action to occur whereby gravity flow of liquid through said discharge line will suck liquid into the cylinder through said inlet and past said inlet check valve, (h) said additional check valve comprising an apertured valve plate disposed at the bottom of the cylinder and in the path of liquid flow, (i) a valve membrane adjacent said plate and adapted to close off the apertures therein in response to the tendency for liquid to flow in one direction, (j) said apertured valve plate and said membrane having central openings adapted to be aligned with one another, (k) a securement thimble extending through said aligned openings and retaining the membrane against permanent dislodgement from the apertured valve plate, (l) said thimble having spaced-apart annular shoulder means, one of said shoulder means being engageable with said plate and the other of said shoulder means being engageable with the membrane to enable the latter to occupy a position completely spaced from the plate under the action of liquid flowing into the inlet, (m) the distance between said shoulder means being substantially in excess of the combined thicknesses of the plate and membrane in order to permit the latter to occupy said spaced position with respect to said plate, so as to present minimal impedement to the flow of liquid through said apertures when the membrane is spaced from the plate, (n) the said membrane being resilient, to enable it to assume a convex-concave configuration under the action of liquid flow.

4. A combination vacuum lift pump and siphon for handling liquids, comprising in combination:

(a) a pump cylinder having an inlet adjacent its bottom, and an outlet spaced downward from its top, (b) a discharge line connected to said outlet and depending therefrom, (c) a plunger reciprocatable in the cylinder, including a piston movable from a location low in the cylinder to a location above the said outlet, (d) said piston having a check valve operable to be closed when the plunger is lifted to raise the piston, (e) an additional check valve connected with said inlet to restrain movement of liquid out of the cylinder through said inlet, (f) reciprocative movements of said piston in portions of said cylinder below said outlet being operative to vacuum lift liquid into the cylinder through said inlet, and to force said liquid out of said outlet, (g) said pisto when raised in the cylinder above said outlet enabling a siphon action to occur whereby gravity flow of liquid through said discharge line will suck liquid into the cylinder through said inlet and past said inlet check valve, (h) said additional check valve comprising an apertured valve plate disposed at the bottom of the cylinder and in the path of liquid flow, (i) a valve membrane adjacent said plate and adapted to close off the apertures therein in response to the tendency for liquid to flow in one direction, (j) said apertured valve plate and said membrane having central openings adapted to be aligned with one another, (k) a securement thimble extending through said aligned openings and retaining the membrane against permanent dislodgement from the apertured valve plate, (l) said thimble having spaced-apart annular shoulder means, one of said shoulder means being engageable with said plate and the other of said shoulder means being engageable with the membrane to enable the latter to occupy a position completely spaced from the plate under the action of liquid flowing into the inlet, (m) the distance between said shoulder means being substantially in excess of the combined thicknesses of the plate and membrane in order to permit the latter to occupy said spaced position with respect to said plate, so as to present minimal impedement to the flow of liquid through said apertures when the membrane is spaced from the plate, (n) said thimble being loosely carried on said valve plate.

* * * * *